United States Patent [19]

Shinozaki et al.

[11] 4,232,104

[45] Nov. 4, 1980

[54] SUBSTRATES FOR USE IN SCREEN PHOTOSENSITIVE ELEMENT

[75] Inventors: Sohji Shinozaki; Yoshiaki Takei, both of Hachioji, Japan

[73] Assignee: Konishiroku Photo Industry Co., Ltd., Tokyo, Japan

[21] Appl. No.: 905,036

[22] Filed: May 9, 1978

[30] Foreign Application Priority Data

May 11, 1977 [JP] Japan ..... 52-53220

[51] Int. Cl.[2] ..... G03G 5/04

[52] U.S. Cl. ..... 430/68; 427/243; 427/247; 428/137

[58] Field of Search ..... 96/1.5 R, 1.5 N, 1.8; 355/35 C; 427/243, 247

[56] References Cited

U.S. PATENT DOCUMENTS 3,976,484 8/1976 Ando et al. ..... 355/325 C X 4,092,160 5/1978 Jackson et al. ..... 96/1.5 N X 4,099,863 7/1978 Nakatsubo et al. ..... 355/35 C

*Primary Examiner*—Roland E. Martin, Jr.

*Attorney, Agent, or Firm*—Haseltine, Lake & Waters

[57] ABSTRACT

The conductive substrate is formed so that the pore openings therein gradually expand in size from one side to the other side of the substrate. When the subtrate is operated with an insulating material from the side having the larger openings, the insulating material adheres to the inclined internal circumferential surface of the pores. When a conductive layer is formed by vacuum evaporation deposition on the insulating layer, there is no short-circuit formed between the conductive layer and the substrate due to the complete insulation of the substrate without diminishing the size of the pore openings. The ratio of the smaller width of the openings to the larger width and the ratio of the depth of the inclined portion of each micro-opening to the thickness of the substrate are respectively within the range of from 1/5 to 4/5.

2 Claims, 5 Drawing Figures

SUBSTRATES FOR USE IN SCREEN PHOTOSENSITIVE ELEMENT

This invention relates to substrates for use in a screen photosensitive element.

Figure 1:
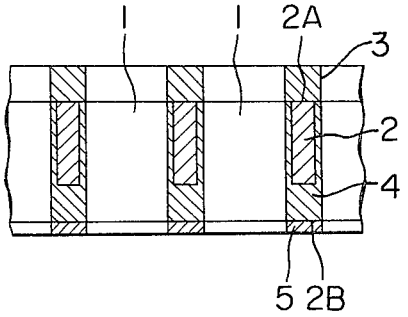

Multi-coated screen photosensitive elements are known as is seen in Japanese Patent Publication No. 59840/1973. The known multi-coated photosensitive element, as schematically shown in FIG. 1 of the accompanying drawings, usually has a structure comprising a photoconductive photosensitive layer 3 formed on one side of a metal substrate 2 having a plurality of micro-pores (openings) 1, an insulating layer 4 formed on the other side of said substrate 2 and the internal circumferential surface of each of said micro-pores 1, and a conductive layer 5 formed on the surface of said insulating layer 4. This known multi-coated screen photosensitive element of such structure is used for forming a static latent image, for example, according to the following procedure.

That is, after uniformly charging the photosensitive layer 3 of the above-mentioned screen photosensitive element in a dark chamber by means of a primary corona discharge, an image of an original is exposed to light to form a primary static image, and subsequently an insulated recording material retained, while leaving a minute gap distance, on said photosensitive layer 3 is irradiated through said screen photosensitive element with a charged corpuscular beam by means of a secondary corona discharge or the like from the opposite side, i.e. the side of the aforesaid conductive layer 5. In that case, when an appropriate bias voltage is applied to said conductive layer 5, an electric field is formed within the micro-pores 1 of said screen photosensitive element, said electric field having a strength corresponding to the amount of charge forming said primary static image thereabouts, and thus formed electric field acts as an electric field of either promoting or blocking the pass through the screen photosensitive element of the said charged corpuscular beam. As a result, the said recording material becomes irradiated with the charged corpuscular beam in the amount corresponding to the said primary static image, and accordingly a static latent image corresponding to the image of the said original can be formed on the irradiated recording material. By virtue of selecting the polarity and value of the said bias voltage, and of selecting the polarity and strength of the said charged corpuscular beam, in the above case, a static latent image corresponding to a positive or negative of the image of the said original by the application of charge with a desired polarity can be formed on the recording material. The static latent image thus formed can be visualized by development according to procedures, per se, known such as dry, wet, spray and the like methods.

In comparison with the case of ordinary electrophotography where a static latent image is formed directly on a photoconductive photosensitive layer of a electrophotographic photosensitive material, when a copied image is intended to be obtained using a screen photosensitive element having a photoconductive photosensitive layer in the manner above explained, there are brought about such advantages that there is no need of participation of the surface of the said photosensitive layer 3 in rubbing a developer for development, transferring the developed image onto a recording paper and in cleaning a residual toner after the transfer, and consequently the lifetime of the screen photosensitive element is markedly prolonged and, moreover, there can be used a toner having desired toner characteristics.

As substrate 2 of such screen photosensitive element as referred to above, there has heretofore been used a woven screen net having minute meshes prepared using fine wires of about 20–80$\mu$ in diameter, said wire being made of a metal such as iron, nickel, chromium, copper, zinc or aluminum, or of an alloy, e.g. stainless steel or brass, or a plated screen net of about 20–100$\mu$ in thickness formed by electrodeposition, according to the electroforming technique, from an aqueous solution of a salt of the aforesaid metal or alloy, or a metal photoetched mesh formed according to the photoetching technique from a plate of the aforesaid metal or alloy of about 20–100$\mu$ in thickness having uniformly formed micropores all over its surface. In a substrate of the first type, the number of wires are usually within the range of 50–300 pieces/inch, though the number may vary depending upon resolving power or gradation as expected.

However, in a screen photosensitive element using as its substrate the aforesaid woven screen net, no uniform characteristics can be obtained on the whole because the meshes of said net are low in opening accuracy, and in a screen photosensitive element using as its substrate the aforesaid plated screen net, the tensile strength of said net is small, and thus both elements cannot be sufficiently put to practical use.

In the aforesaid metal photoetched mesh, on the other hand, the micro-pores may be readily formed into any shapes as desired, e.g. a triangle, square, hexagon or circle, a high opening accuracy of mesh can be attained and the physical strength of the mesh is sufficient. In the case where this metal photoetched mesh is used as a substrate in a screen photosensitive element, however, the resulting screen photosensitive element is hardly found to be satisfactory as expected. That is, in the metal photoetched mesh obtained by subjecting the surface of a flat plate of a metal to etching, thereby forming pores thereon, the pores 1 as shown in (A) of FIG. 2 come to be defined by internal circumferential surfaces at right angles to one side 2A and the other side 2B of the substrate 2. By spraying this substrate 2, for example, from the side of the other side 2B in the direction of right angles to said substrate 2, with an insulating material, the insulating layer 4 is formed on said other side 2B. In this case, however, the insulating material being sprayed passes through the internal circumferential surfaces of said pore 1 without adhering thereto, because said internal circumferential surfaces are present in the same direction as in said insulating material being sprayed. Subsequently, as shown in (C) of FIG. 2, a conductive material such as aluminum, nickel, copper, gold or platinum, is evaporation-deposited, for example, according to the vacuum evaporation coating technique, on the upper side of the said insulating layer 4 (this side being shown downward in this figure), thereby forming a conductive layer 5. In this case, however, since the above-mentioned metal having a long average free path linearly evaporates as shown by arrows from an evaporation source 6, the conductive layer 5 formed by evaporation-deposition of said metal on the said upper side of the insulating layer 4 has skirt portions 5' simultaneously formed by evaporation-deposition of the metal on a portion out of the internal circumferential surfaces of the pores 1, said portion being directly opposite to said evaporation source 6. However, the metal surface of the said substrate 2 is exposed in the internal circumference of the pore 1, with result that the said conductive layer 5, which is to be insulated by means of the said insulating layer 4 from the said substrate 2, becomes short-circuited with the substrate 2 through the said skirt portions 5'.

Figure 3:
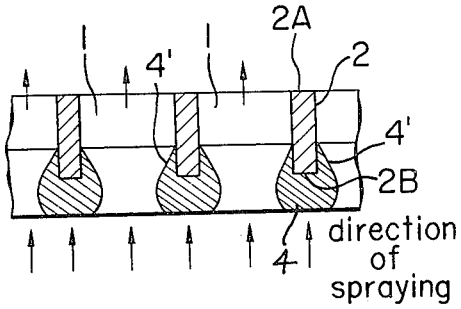

In attempting to prevent such short-circuit as mentioned above, it is considered that the conductive layer 4 is formed by spraying the substrate 2 with a large amount of an insulating material in the form of a solvent solution of a resin having a high swelling action, so that part of the insulating material is allowed to adhere to the internal circumferential surface of the pore 1 as shown in FIG. 3, thereby to form the portion 4' through which the said skirt portion 5' of the said conductive layer 5 and the substrate 2 are insulated from each other. However, because the said insulating layer 4 grows so as to narrow the pore 1 with the progress of formation of the said portion 4' of the insulating layer 4, the percent of opening of the pore 1 is lowered, and there is a possibility that the pore 1 will eventually be blocked by said growing insulating layer 4 and, moreover, it is difficult to form the said insulating layer portion 4' all over the internal circumferential surface of the pore 1.

The present invention is to provide a substrate for use in a screen photosensitive element, said substrate being freed from such drawbacks as mentioned above, by the use of which there is obtained simply and assuredly a screen photosensitive element having an insulating layer not only on the surface of its substrate but also on the internal circumferential surfaces of the pores of said substrate and accordingly having a conductive layer perfectly insulated from the substrate and moreover retaining a high percent of opening in the pores of said substrate.

Figure 2A:
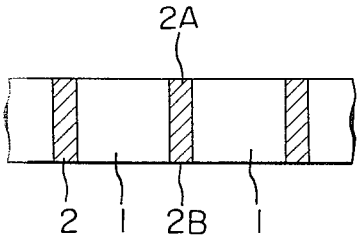
Figure 2B:
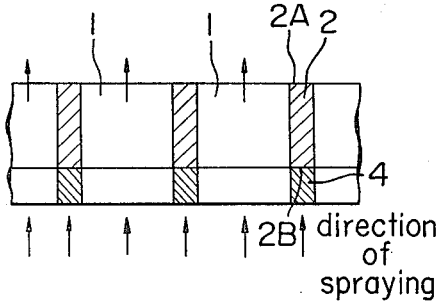
Figure 2C:
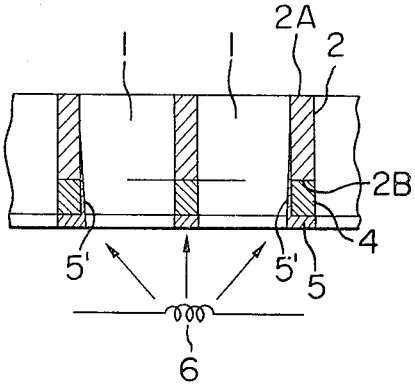
Figure 4:
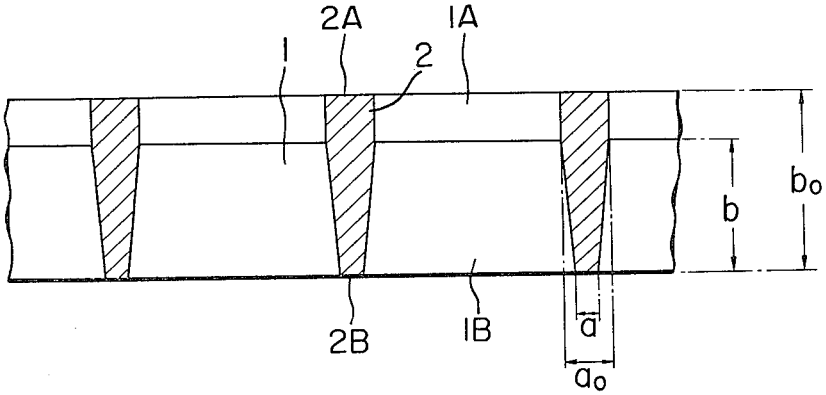
Figure 5:
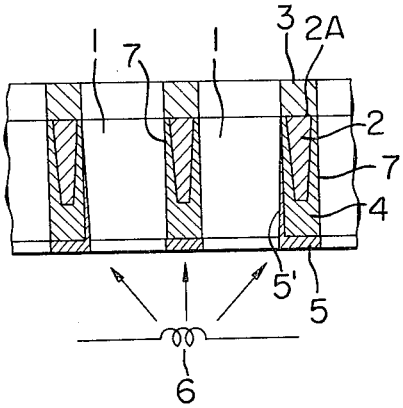

An example of the embodiments of the present invention is illustrated below with reference to the accomanying drawings in which FIG. 1 is a cross sectional view schematically showing the fundamental structure of a screen photosensitive element, FIGS. 2 and 3 are cross sectional views showing screen photosensitive elements in which conventional substrates were used, FIG. 4 is a cross sectional view showing a substrate for use in the screen photosensitive element according to the present invention, and FIG. 5 is a cross sectional view showing a screen photosensitive element obtained using the substrate of the present invention, and of the figures in bold type indicated therein, 1 representing a pore, 2 a substrate, 3 a photoconductive photosensitive layer, 4 an insulating layer, 5 a conductive layer, 6 an evaporation source and 7 a coated portion of the internal circumferential surface.

In the present invention, a conductive substrate is used, said substrate having a plurality of pores 1, for example, in the proportion of 50 to 300 meshes per inch, and each of said pores gradually expanding its opening as approaching from one side 2A to the other side 2B. Such substrate 2 has a thickness, for example, from 20 to 100 microns, and may be prepared by placing on one side of a starting metal plate a photoresist film having a shape corresponding to that of one side 2A of the substrate 2, that is to say, said photoresist film has pores corresponding to openings of the pores 1 formed on said one side 2A of the substrate 2, and simultaneously a photoresist film having a shape corresponding to that of the other side 2B of said substrate 2 is placed likewise on the other side of said metal plate, and then said metal plate having said photoresist films respectively on its both sides is subjected to etching from its both sides.

For obtaining a screen photosensitive element by the use of this substrate 2, it is sufficient that the substrate 2 is sprayed, as shown in FIG. 5, with an insulating material from the side of the other side 2B at right angles to said substrate 2, thereby forming a insulating layer 4 on the other side 2B of said substrate 2 and then a conductive layer 5 is formed on said insulating layer 4 positioned on the other side 2B of said substrate 2, and further a photoconductive photosensitive layer 3 is formed on one side of said substrate 2.

In the present invention as above explained, the opening of pore 1 of the substrate 2 gradually expands as it approaches the other side 2B. In the step of forming the said insulating layer 4, therefore, the insulating material being sprayed at right angles to the said other side 2B will adhere also to the inclined internal circumferential surface of the said pore 1, and thus the insulating layer to be formed thereby will have an internal circumferential coated portion 7 in a body. As a result, even when vacuum evaporation deposition is adopted to form the condutive layer 5 and consequently said conductive layer 5 to be formed has in a body a skirt portion 5' of said conductive layer 5, said portion 5' entering the pore 1 is spread over the internal circumferential surface of said pore 1, said portion 5' becomes positioned on the said internal circumferential coated portion 7, and thus an electrical short-circuit between said conductive layer 5 and the substrate 2 can be assuredly prevented. Moreover, since the said internal circumferential surface coated portion 7 is formed from the insulating material that adhered thereto so as to correspondingly compensate the expanded portion of the pore 1, said internal circumferential surface coated portion 7 will not grow inwardly over the internal circumference of the opening of the pore 1, and thus there is no possibility that the percent of opening of the pore 1 is lowered or said pore 1 is blocked by the conductive layer 5 formed thereby.

In the treatment for forming the said bore 1 in the substrate, as shown in FIG. 4, the pore 1 is so formed as to comprise a parallel portion 1A defined by its circumferential wall, though it is very small, extending at right angles from one side 2A of the substrate 2 and, in succession thereto, a inclined sectional portion 1B extending outwardly, and thus said pore 1 forms a so-called shouldered opening. In the present specification, such state of the opening is referred to as describing "over substantially the whole of the direction of thickness of the substrate". In FIG. 4, a value of $a/a_o$, i.e. the ratio of the size of the surface wire width of the other side 2B of the substrate 2, i.e. the smaller surface wire width, to the size of one side 2A of the substrate, i.e. the larger surface wire width, is preferably within the range from 1/5 to 4/5, and a value of $b/b_o$, i.e. the ratio of depth b of the inclined portion 1B to thickness $b_o$ of the substrate 2, is preferably within the range from 1/5 to 4/5. When the values of these ratios are greater than the upper limits of said ranges, the adhering amount of an insulating material for forming the insulating layer 4 decreases, whereby the area of said insulating layer 4, on which the conductive layer 5 is to be evaporation-deposited, decreases. If the said values are smaller than the lower limits of said ranges, on the other hand, the insulating layer 4 cannot be uniformly formed on the internal circumferential surface of the pore 1.

Usable insulating materials in the present invention explained hereinbefore, are those capable of forming layers having electrically high insulation resistance. The usable insulating material are these which are rendered sprayable after dissolving them in appropriate solvents, for example, solvent solutions of silicone resins, alkyd resins, epoxy resins or vinyl type resins. As stated previously, the materials for forming the conductive layer 5 are preferably such metals as aluminum, nickel, copper, gold and platinum. Formation of the photoconductive photosensitive layer 3 can be accomplished by vacuum evaporating selenium, selenium-tellurium alloy or selenium-arsenic alloy on the substrate or spraying or coating the substrated on the surface with a liquid obtained by dispersing particulate photoconductive material such as zinc oxide or cadmium sulfide in a binder.

In accordance with the present invention, as can be understood from the foregoing explanation, there are brought about such great advantages that the insulating layer having a portion capable of coating the internal circumferential surface of the opening can be readily formed by an extremely simple operation, and even when the conductive layer is intended to be formed on the substrate according to the preferred vacuum evaporation coating technique, said conductive layer can be formed in such a state where the layer is assuredly insulated from the substrate, and thus an excellent screen photosensitive element as expected can be readily obtained in an assured manner without increasing the manufacturing cost thereof.

What is claimed is:

1. In a conductive substrate for use in a screen photosensitive element, which substrate is provided all over its surface with a plurality of micro-openings, said substrate having an insulating layer formed on the surface of one side thereof including an internal circumferential surface of each of said micro-openings and having a conductive layer formed at least on said insulating layer positioned at said surface of one side of said substrate and further a photoconductive photosensitive layer formed on the surface of the other side of said substrate opposite to said one side of said substrate having formed thereon said insulating and conductive layers, the improvement comprising a structure of the substrate, characterized in that each of said micro-openings is formed, the internal circumferential surface of which is inclined over substantially the whole of the direction of the thickness of said substrate so that a wire surface width of said substrate at the side of said insulating layer, which wire surface width corresponds to one circumferential edge of each of said micro-openings, is smaller than that at the side of said photoconductive photosensitive layer, whereby at the time of spraying said substrate from the side of said smaller wire surface width with an insulating material capable of forming said insulating layer the insulating material is allowed to readily adhere to said surface of one side of said substrate and said internal circumferential surface of each of said micro-openings without lowering the percent of opening and further the ratio of the smaller wire surface width to the larger wire surface width and the ratio of the depth of the inclined portion of each micro-opening to the thickness of said substrate are respectively within the range of from 1/5 to 4/5.

2. A structure of a conductive substrate for use in screen photosensitive element according to claim 1, characterized in that the screen is so constructed as to have the mesh range of from 50 to 300, and the thickness of the substrate is 20 to 100 microns.

* * * * *